US009119429B2

(12) United States Patent
Den Dekker et al.

(10) Patent No.: US 9,119,429 B2
(45) Date of Patent: Sep. 1, 2015

(54) GARMENT WITH WATERTIGHT CLOSABLE VENTILATION OPENING

(71) Applicant: Ivan Vos Holding B.V., Berghem (NL)

(72) Inventors: Jasper Camiel Den Dekker, Eindhoven (NL); Guido Kreijkamp, Rosmalen (NL)

(73) Assignee: Ivan Vos Holding B.V., Berghem (NL)

( * ) Notice: Subject to any disclaimer, the term of this patent is extended or adjusted under 35 U.S.C. 154(b) by 252 days.

(21) Appl. No.: 13/630,520

(22) Filed: Sep. 28, 2012

(65) Prior Publication Data

US 2013/0081192 A1 Apr. 4, 2013

(30) Foreign Application Priority Data

Sep. 30, 2011 (NL) ..... 2007513

(51) Int. Cl.
*A41D 27/28* (2006.01)
*A41D 13/002* (2006.01)

(52) U.S. Cl.
CPC ..... *A41D 27/285* (2013.01); *A41D 13/002* (2013.01); *A41D 27/28* (2013.01); *A41D 2400/20* (2013.01); *A41D 2600/102* (2013.01)

(58) Field of Classification Search
CPC ..... A42D 27/28–27/285; A41D 2400/10–2400/20; A41D 2600/102
USPC ..... 2/69, 85, 93, 94, 97, 115, 69.5, 108, 87, 2/79, 102, DIG. 1
See application file for complete search history.

(56) References Cited

U.S. PATENT DOCUMENTS

| | | | | |
|---|---|---|---|---|
| 5,507,042 | A * | 4/1996 | van der Slessen | 2/69 |
| 5,704,064 | A | 1/1998 | van der Sleesen | |
| 5,854,336 | A * | 12/1998 | Divone et al. | 524/588 |
| 6,070,274 | A | 6/2000 | van der Sleesen | |
| 6,085,353 | A | 7/2000 | van der Sleesen | |
| 6,795,976 | B1 | 9/2004 | van der Sleesen | |
| 2012/0017346 | A1 * | 1/2012 | Reimer | 2/69 |
| 2012/0204315 | A1 | 8/2012 | Lambertz | |

FOREIGN PATENT DOCUMENTS

| | | | |
|---|---|---|---|
| DE | 202009005236 | U1 | 3/2010 |
| WO | 9624263 | A1 | 8/1996 |

* cited by examiner

*Primary Examiner* — Khoa Huynh
*Assistant Examiner* — Khaled Annis
(74) *Attorney, Agent, or Firm* — The Webb Law Firm

(57) ABSTRACT

The invention relates to a garment, comprising an outer fabric extending over at least a part of the garment and provided with a closable ventilation opening, a closing means for the opening comprising an orientation closing the opening and an orientation leaving clear the opening, a material extending at least over the ventilation opening and provided with at least one ventilation hole, a water barrier at least partly enclosing the at least one ventilation hole, wherein the water barrier lies against the closing means with a bias in the orientation of the closing means closing the opening.

15 Claims, 8 Drawing Sheets

GARMENT WITH WATERTIGHT CLOSABLE VENTILATION OPENING

BACKGROUND OF THE INVENTION

1. Field of the Invention

The present invention relates to a garment, particularly to a jacket or trousers for activities during which the wearer is subjected to a relatively large airflow, such as riding a motorcycle or skiing.

2. Description of Related Art

Such garments are per se known. They serve on the one hand to protect the wearer from cold and on the other to prevent minor injury to the wearer in the case of a fall. In addition to protecting against a low ambient temperature, the protection from cold also serves the purpose of protecting against penetration of moisture (rainwater) and wind (created by travel/movement). The garments for this purpose take a largely wind and moisture-tight form.

During strenuous activity, at high temperatures and/or moderate wind, a wearer can become extremely warm. In order to provide the possibility of cooling down in such conditions it is usual to arrange closable ventilation openings in the garment. These comprise for instance a sealable opening. Different configurations are known here. Firstly, there are garments provided with a watertight layer, also referred to as a membrane, which can optionally be uncoupled from the outer fabric of the garment. Because the membrane is watertight and in the known garments ventilation takes place at the membrane, few stringent requirements in respect of watertightness need be set for the closing action of the closable opening.

The present invention lies in the field of a closable opening for the purpose of ventilation, watertight in closed position, which enables direct ventilation to the skin. It is an object here of the present invention to achieve an improved garment which enables direct ventilation to the body in open state and is watertight in closed state.

SUMMARY OF THE INVENTION

The invention provides for this purpose a garment comprising an outer fabric extending over at least a part of the garment and provided with a closable ventilation opening, a closing means for the opening, comprising an orientation closing the opening and an orientation leaving clear the opening, a material extending at least over the ventilation opening and provided with at least one ventilation hole, a water barrier at least partly enclosing the at least one ventilation hole, wherein the water barrier lies against the closing means with a bias in the orientation of the closing means closing the opening. The outer fabric of the garment can be made up of a plurality of layers, for instance two or three layers.

A (motorcycle) garment made up of two or three layers is generally understood to mean a garment consisting of an outer fabric (which need not be watertight, and generally is not), then a second layer consisting of an optionally removable (watertight) membrane, and subsequently another optionally removable thermal lining.

In an embodiment of the present invention this outer fabric already consists per se of two or three layers which are directly 'fused' together. This can be an outermost outer fabric against which a second moisture-proof layer is directly laminated (the outermost outer fabric material is then fused with a moisture-proof/watertight layer). Another third layer can then be arranged, which increases the wearer comfort against the skin. This can comprise a mesh lining or for instance a tricot layer.

The closing means can here form part of the outer fabric. The closable ventilation opening can for instance be formed by a cut in the fabric which can for instance have an I, L or U-shape. It is however also possible to remove a portion from the fabric, for instance a circular or rectangular portion, and to provide a flap which can close over this portion.

The bias provides that water, which has managed to penetrate or bypass the closing means in the orientation closing the opening, is nevertheless held back by the water barrier and the connection of the water barrier and the closing means. It is therefore logically recommended to place the water barrier such that it blocks a path for the water from the outside of the garment when the closing means is situated in the orientation closing the opening.

A good seal can for instance be obtained when the water barrier comprises an elastic, upright protrusion. Such a protrusion can for instance be manufactured from a synthetic rubber-like material such as a thermoplastic urethane.

The water barrier can be attached here to the material extending over the ventilation opening, preferably by means of a stitchless attachment such as a weld, which is arranged for instance by means of high-frequency welding. In this way use need not be made of stitches, perforations or other connections which may result in leakage. Such a connection is not always possible or desirable in the case of the outer fabric.

The material extending over the ventilation opening can then be connected in per se known manner to the outer fabric, for instance by means of stitching covered with a laminating tape in order to guarantee water tightness.

In an alternative embodiment the elastic, upright protrusion is formed by a hemmed cord or a hemmed thread. The cord or the thread can be manufactured here from an elastic material, or the cord or the thread can be hemmed such that the surrounding fabric forces this cord or this thread in the direction of a closing means.

The water barrier can substantially correspond to the contour of the opening and have for this purpose an I, L or U-shape, although it can also wholly enclose the at least one ventilation hole. Such an embodiment provides very good protection against penetrating moisture.

In an embodiment the material extending over the ventilation opening comprises a plurality of ventilation holes, wherein there is also a plurality of water barriers, each enclosing at least one ventilation hole. An even better moisture-tightness is acquired in this way. In such an embodiment the material covering the opening can be dispensed with or deemed to be incorporated integrally in the water barrier.

The closing means can be provided here with at least one protrusion co-acting with the water barrier. This can for instance take the form of a stud arranged such that the water barrier connects thereto. A very good seal is obtained by also manufacturing the stud from an elastic material. The use of a plurality of barriers and studs further allows variation in the amount of air which is admitted.

The closing means can be adapted to be connected along the whole edge of the opening and can for instance comprise for this purpose a zip or Velcro tape. It can in addition be provided with a fixing means for holding the closing means in an opened position.

BRIEF DESCRIPTION OF THE DRAWINGS

The invention will now be elucidated with reference to the following figures, in which.

DETAILED DESCRIPTION OF THE PREFERRED EMBODIMENTS

Figure 1:
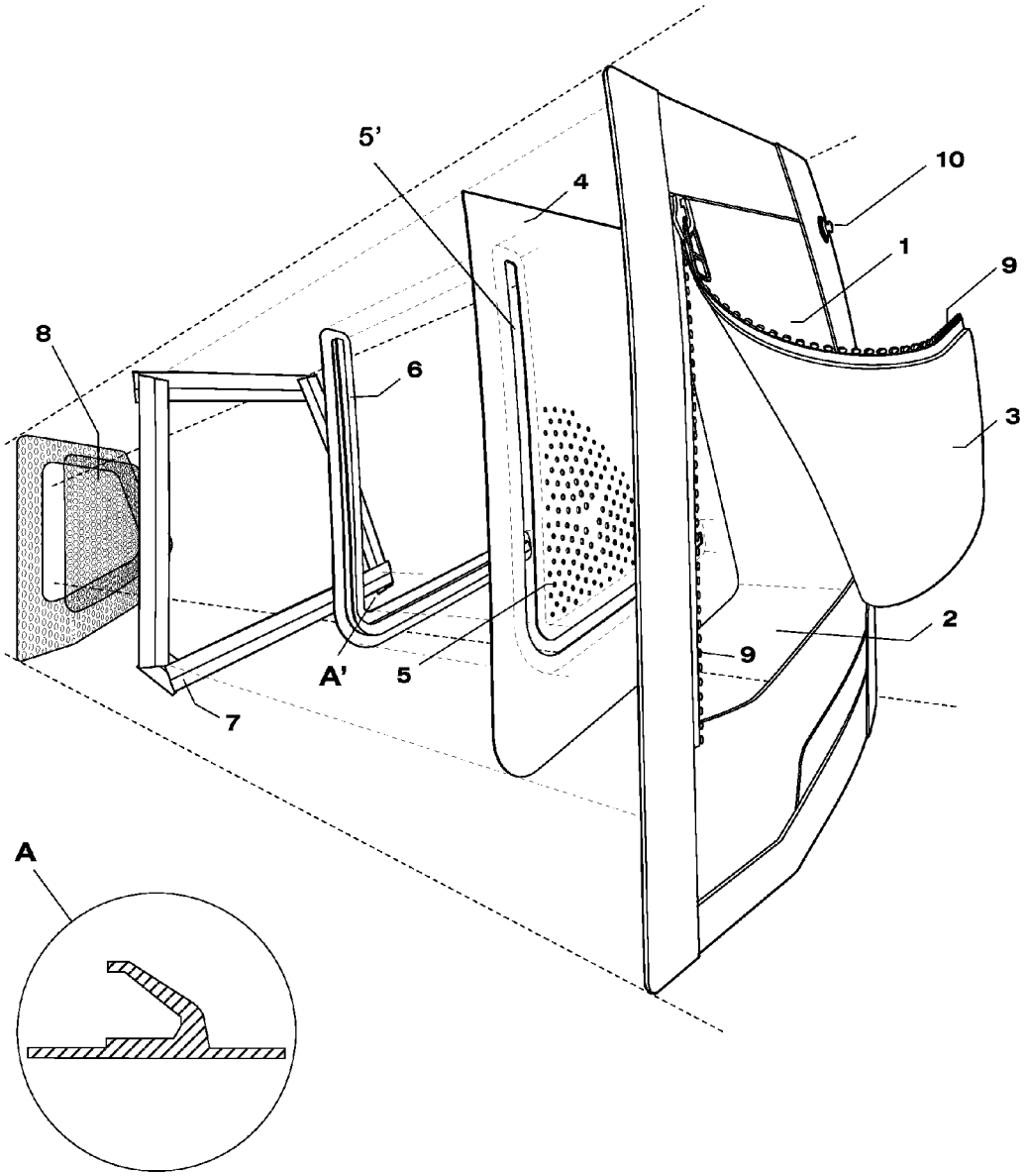
FIG. 1 shows a perspective exploded view of a first embodiment of the invention.

FIG. 1 shows a perspective exploded view of a first embodiment of the invention. The figure shows an outer fabric 1 extending over at least a portion of the garment and provided with a closable ventilation opening 2 which can be closed with a closing means 3, which is shown in the figure in an orientation leaving the opening clear. Situated behind the opening is a material 4 extending at least over the ventilation opening and provided with ventilation holes 5 and an L-shape elongated channel 5', behind which an L-shape water barrier 6 is fitted completely within said elongated material channel to directly contact the closing means 3. Inset A shows a cross-section of the water barrier along line A'. It can be seen that the barrier protrudes, whereby it lies against the closing means with a bias in the orientation of the closing means closing the opening. The water barrier is manufactured from a water-impermeable material, is elastic and manufactured in the shown embodiment from thermoplastic urethane. In an assembled state the water barrier 6 is attached by means of high-frequency welding to the material 4 which extends over the ventilation opening and which is attached to outer fabric 1 by means of stitching covered with tape 7. A mesh 8 is further provided for the purpose of distributing within the garment the air admitted through ventilation holes 5. The mesh is a so-called 3D Mesh, a spatially arranged material which, in addition to protecting against flies and so on, ensures that the whole material is held a distance from the skin. It hereby functions as spacer for the outer fabric with ventilation opening relative to the body so that an optimal airflow can take place.

Closing means 3 is provided with a closure, in this case with a zip fastening 9, in order to hold it in the closed state, and a fixing means, in this case a press-stud 10, to fix it in the opened position. The L-shape of water barrier 6 is chosen to match the shape of opening 2. In the case of an L-shape it is moreover possible here for the corner points (being the outer ends of the water barrier) to be covered by means of a tape in order to guarantee a watertight construction.

In every embodiment in which the water barrier is finite (so not closed) the gutter can protrude over a decreasing height toward the outer ends, i.e. decrease in thickness toward the outer ends.

Figure 2:
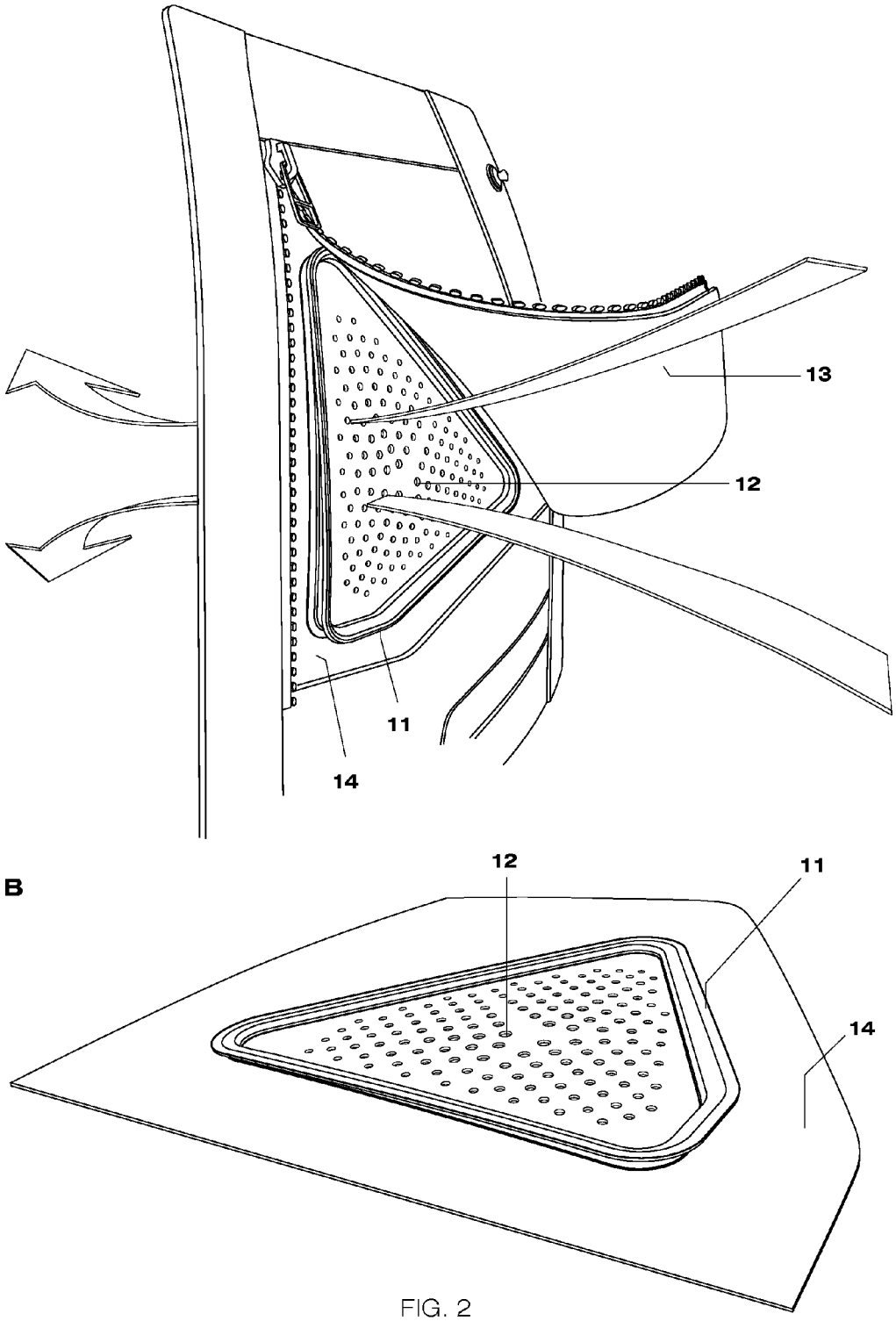
FIG. 2 shows a perspective view of a second embodiment of the invention.

FIG. 2 shows a perspective view of a second embodiment of the invention, wherein a water barrier 11 encloses a number of ventilation openings 12. Water barrier 11 hereby connects all the way round onto closing means 13, whereby a complete sealing can be realized. Inset B shows a perspective view of just the water barrier and the material 14 which extends over the ventilation opening and comprises ventilation holes 12, and to which water barrier 11 can be attached by means of a weld. The height of the water barrier decreases in the direction of the corner where the zip is located in the shown embodiment. This optional measure can be applied if the covering, as in the shown embodiment on the side where it is permanently adhered, tends to naturally exert a greater bias on the water barrier due to the construction of the adhesion.

Figure 3:
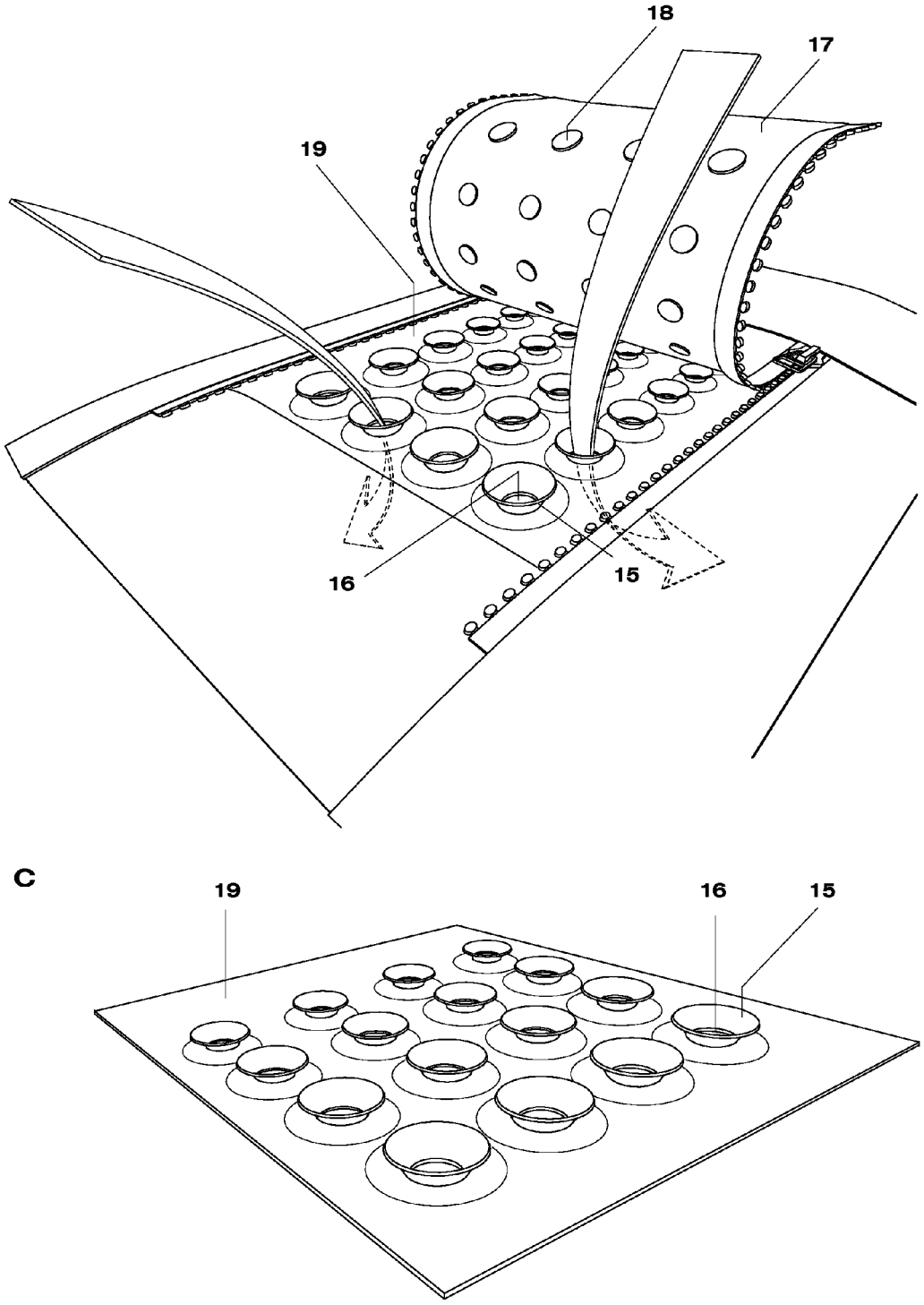
FIG. 3 shows a perspective view of a third embodiment of the invention.

FIG. 3 shows a perspective view of a third embodiment of the invention, wherein a plurality of water barriers 15 are provided which each enclose a ventilation opening 16. Inset C shows a perspective view of just the water barriers 15 enclosing ventilation holes 16 and the material 19 which extends over the ventilation opening and to which the water barriers can be attached by means of a weld. The height of the water barrier decreases in the direction of the side to which the seal is adhered. This optional measure results in a more uniform distribution of forces.

Closing means 17 is provided with studs 18 which drop into barriers 15 of ventilation openings 16 and thus provide for a very good seal.

Figure 4:
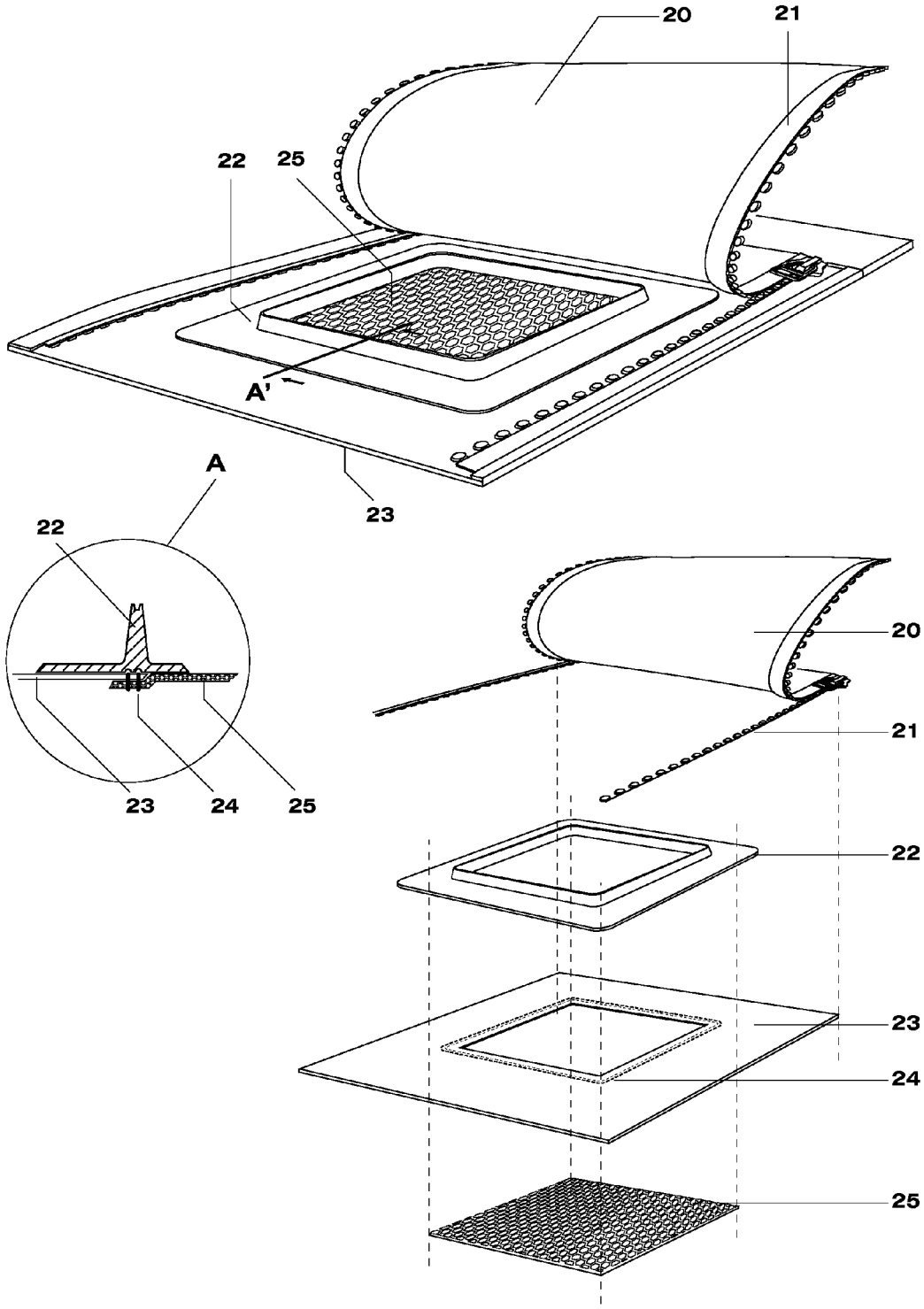
FIG. 4 shows a subsequent embodiment of the invention.

FIG. 4 shows a subsequent embodiment of the invention wherein a covering means 20 is provided in a part of the fabric 23 of a garment. Covering means 20 is closed by means of a zip fastening and/or Velcro tape 21. The actual ventilation opening comprises an injected rubber part 22 on which is arranged a gutter inside which is arranged a surface which has been left clear and behind which a mesh 25 is placed for passage of ventilation air. Inset A shows a cross-section along line A'.

Figure 5:
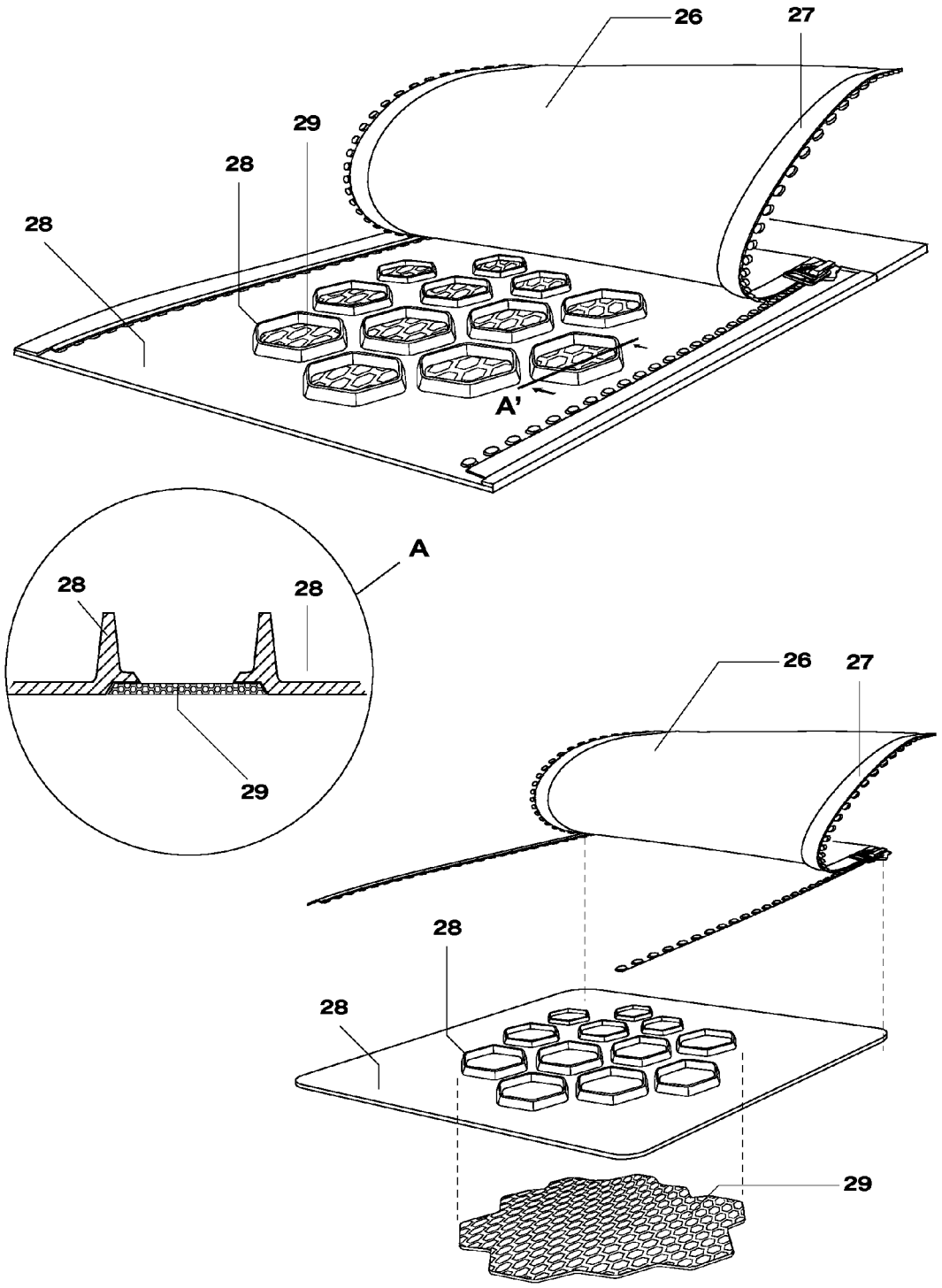
FIG. 5 shows another alternative exemplary embodiment.

FIG. 5 shows an alternative exemplary embodiment in which a sealing means 26 is provided which can be attached by means of a zip fastening and/or Velcro tape 27. Instead of one large opening, the rubber injected part 28 now comprises a plurality of small openings behind which a shared mesh 29 is placed in the shown embodiment. It is of course also possible to provide each opening with a separate mesh. Inset A once again shows a cross-section along line A'.

Figure 6:
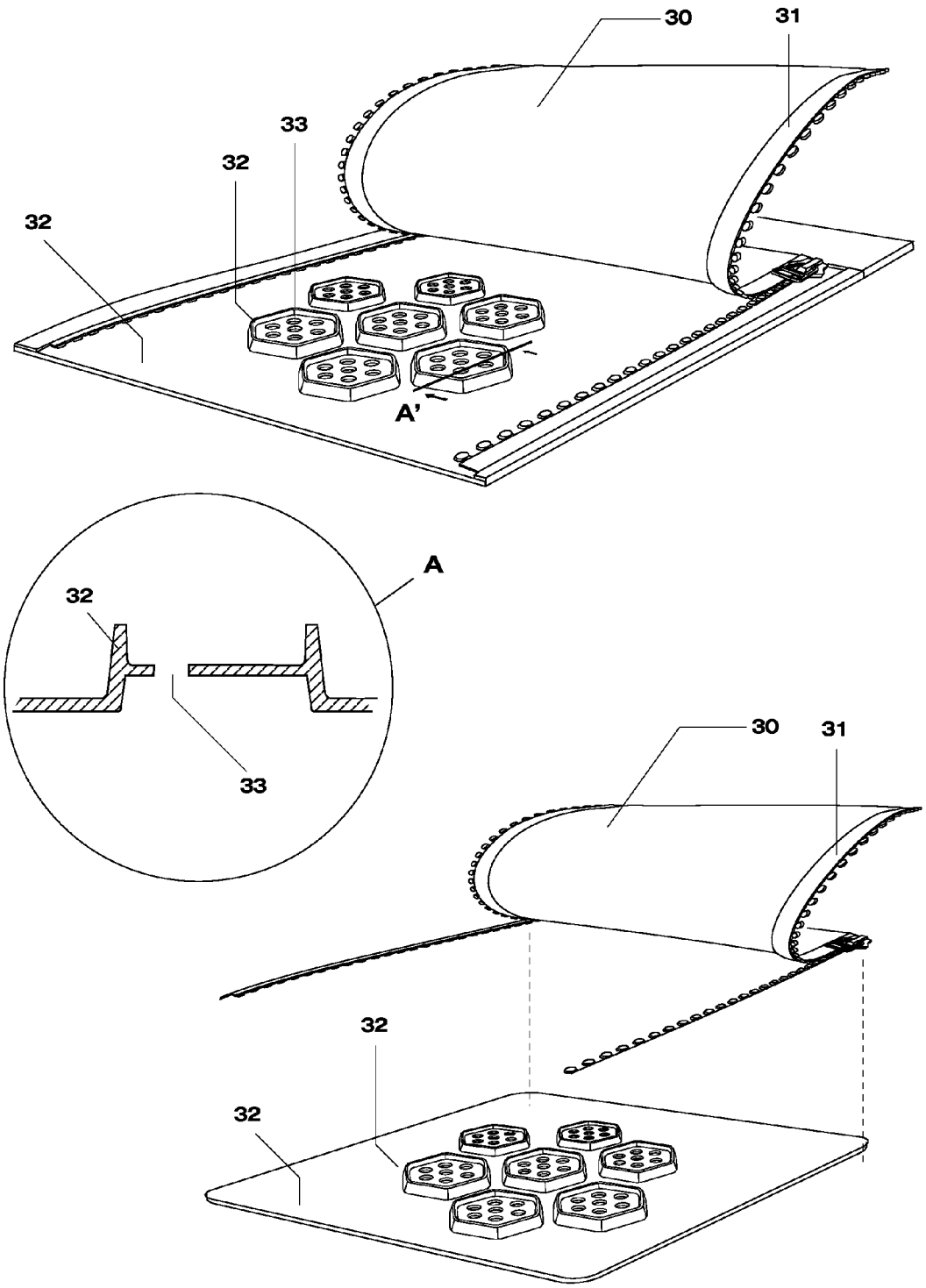
FIG. 6 shows a subsequent alternative embodiment.

FIG. 6 shows a subsequent alternative embodiment, wherein a mesh 33 is formed integrally with water barrier 32. As in the embodiments above, a sealing means 30 is provided which can be attached by means of a zip fastening and/or Velcro tape 31.

Figure 7:
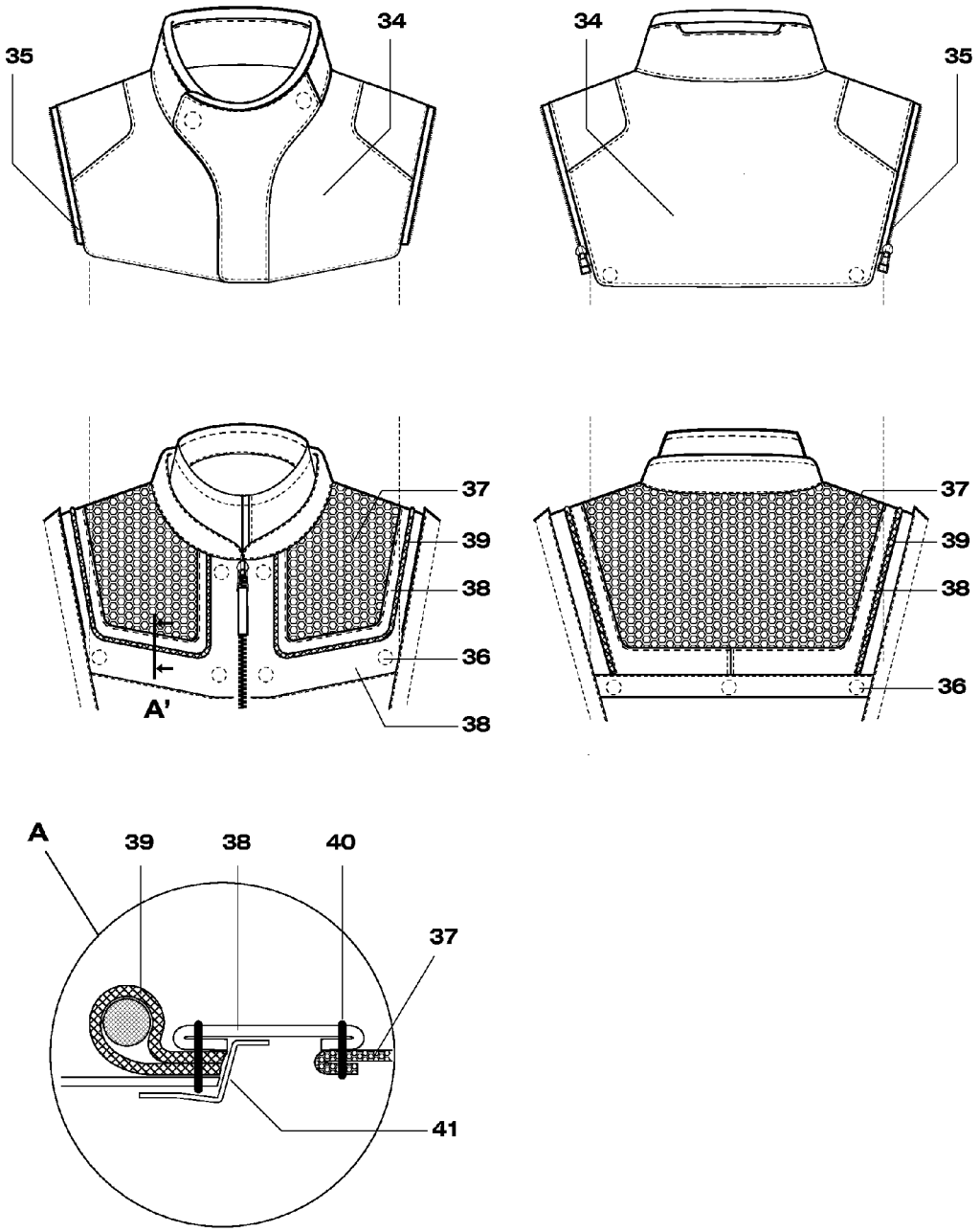
FIG. 7 shows several views of a subsequent embodiment.

FIG. 7 shows a number of views of a subsequent embodiment wherein the sealing means comprises a collar 34 which can be connected to the rest of the garment, in this case a jacket, by means of a zip 35. In addition to the zip an (optional) magnetic connection 36 is provided at several points. Inset A shows that the elastic, upright protrusion comprises a hemmed cord 39 or a hemmed thread 39, hemmed such that the surrounding fabric urges this cord or this thread in the direction of a closing means. The hemmed thread 39 is attached to the watertight outer material 38 of the garment by means of stitching 40, to which mesh 37 is also connected. A tape 41 is arranged to further prevent leakage.

Figure 8:
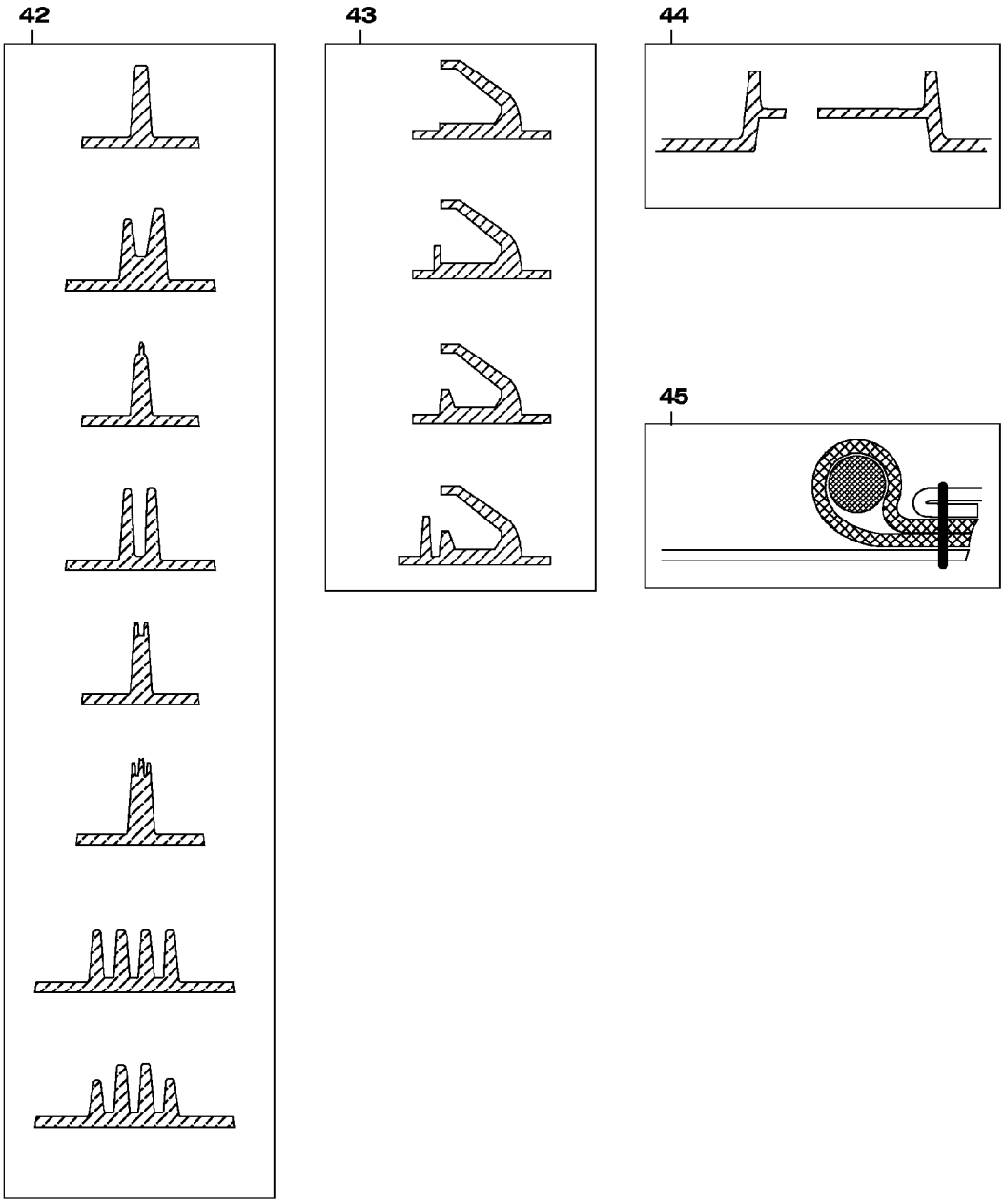
FIG. 8 shows a number of embodiments of water barriers for use in the present invention.

FIG. 8 shows a number of embodiments of water barriers for use in the present invention. Box 42 shows a number of flexible, upright plastic protrusions injected directly onto the outer fabric and manufactured for instance from PVC or PU. Box 43 shows high-frequency welded, flexible, upright injection-moulded plastic protrusions. Box 44 shows upright protrusions formed from thermally deformable material (for instance EVA) and with punched ventilation openings. Box 45 shows the variant applied in FIG. 7 with a hemmed thread.

The invention claimed is:

1. A garment, comprising:

an outer fabric extending over at least a part of the garment and provided with a closable ventilation opening;

a closing means for the opening, comprising:

an orientation closing the opening, and an orientation leaving clear the opening for allowing an airflow oriented directly toward a wearer of the garment, a material extending at least over the ventilation opening and provided with at least one ventilation hole and an elongated material channel;

a water barrier at least partly enclosing the at least one ventilation hole, wherein said entire water barrier is fitted completely within said elongated material channel to directly contact the closing means; wherein, the water barrier provides a biasing force on the closing means in the orientation of the closing means closing the opening.

2. The garment as claimed in claim 1, wherein the water barrier is manufactured from a water-impermeable material.

3. The garment as claimed in claim 1, wherein the water barrier comprises an elastic, upright protrusion.

4. The garment as claimed in claim 1, wherein the protrusion is manufactured from thermoplastic polyurethane.

5. The garment as claimed in claim 1, wherein the elastic, upright protrusion comprises a hemmed cord or a hemmed thread.

6. The garment as claimed in claim 5, wherein the cord or the thread is manufactured from an elastic material.

7. The garment as claimed in claim 5, wherein the cord or the thread is hemmed such that the surrounding fabric forces this cord or this thread in the direction of a closing means.

8. The garment as claimed in claim 1, wherein the water barrier is attached to the material extending over the ventilation opening.

9. The garment as claimed in claim 5, wherein the attachment is a stitchless attachment such as a weld.

10. The garment as claimed in claim 9, wherein the weld is arranged by means of high-frequency welding.

11. The garment as claimed in claim 1, wherein the water barrier encloses the at least one ventilation hole.

12. The garment as claimed in claim 11, wherein the material extending over the ventilation opening comprises a plurality of ventilation holes, and wherein there is a plurality of water barriers, each enclosing at least one ventilation hole.

13. The garment as claimed in claim 1, wherein the closing means is provided with at least one protrusion co-acting with the water barrier.

14. The garment as claimed in claim 1, wherein in the orientation closing the opening the closing means is adapted to be connected along a whole edge of the opening to the outer fabric.

15. An assembly of a water barrier for use in a garment as claimed in claim 1, including a material extending over a ventilation opening and provided with at least one ventilation hole.

* * * * *